US005221806A

United States Patent [19]

Chaney et al.

[11] Patent Number: 5,221,806

[45] Date of Patent: Jun. 22, 1993

[54] MULTIPLE PURPOSE DIE FOR RELOADING PRESS

[75] Inventors: Arlen Chaney, Lewiston, Id.; Walter W. Bender, Oroville, Calif.

[73] Assignee: Blount, Inc., Portland, Oreg.

[21] Appl. No.: 924,366

[22] Filed: Jul. 31, 1992

Related U.S. Application Data

[63] Continuation of Ser. No. 660,783, Feb. 25, 1991, abandoned.

[51] Int. Cl.[5] ..... F42B 33/10

[52] U.S. Cl. ..... 86/19; 86/24; 86/36

[58] Field of Search ..... 29/1.3, 1.31, 1.32; 86/10, 17, 19, 24, 28, 36, 37, 39, 40

[56] References Cited

U.S. PATENT DOCUMENTS

| | | | |
|---|---|---|---|
| 91,058 | 6/1869 | Aiken | 86/19 |
| 3,266,075 | 8/1966 | Conrad | 86/19 |
| 3,736,835 | 6/1973 | Hanson | 86/19 |
| 4,593,598 | 6/1986 | Gunder | 86/36 |
| 4,890,534 | 1/1990 | Bender | 86/19 |

*Primary Examiner*—Charles T. Jordan

*Attorney, Agent, or Firm*—Robert L. Harrington

[57] ABSTRACT

A die for performing multiple operations on a cartridge case in a single operative stroke of a reloading press. The die will uniformly coat the exterior of the case with lubricant, eject the spent primer, resize the exterior of the case, wipe and lightly lubricate the neck interior and resize the neck interior in one operation. The die has an insert that is replaceable and interchangeable with another to accommodate different calibers. A reservoir supplies and uniformly distributes lubricant to a lubricating pad in the entry of the die.

7 Claims, 6 Drawing Sheets

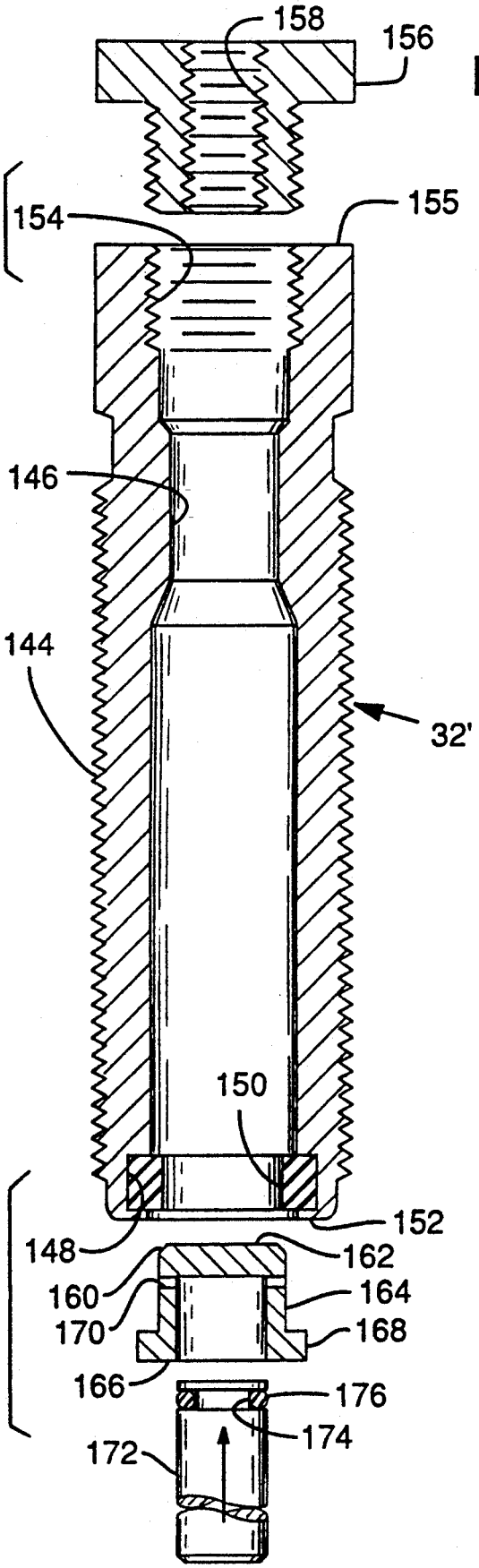
FIG. 6
FIG. 7
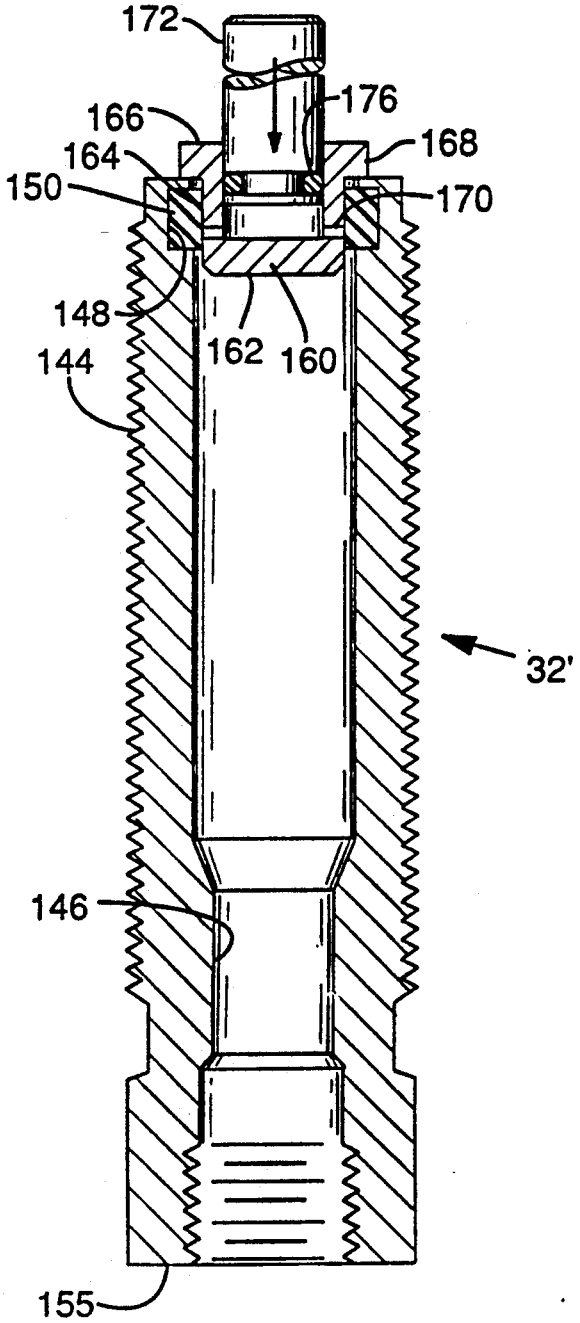

MULTIPLE PURPOSE DIE FOR RELOADING PRESS

This is a continuation of copending application Ser. No. 07/660,783 filed on Feb. 25, 1991 now abandoned.

BACKGROUND INFORMATION

The commonly assigned U.S. Pat. No. 4,890,534 Lubricating Die For Cartridge Reloader issued Jan. 2, 1990 is herein incorporated by reference.

1. Field of the Invention

This invention relates to reloading of firearm cartridge cases and in particular it relates to a multiple purpose die for a reloading press used in the process of reloading cartridge cases.

2. Background of the Invention

Cartridge cases are reloaded by individuals for a variety of reasons. The individual can control the powder charge, the sizing of the bullet, the resizing of the case, the seating of the bullet, and probably one of the most important factors is that the individual can lower the cost per round of ammunition.

When a cartridge case is fired, the case is deformed by the explosive force of the powder igniting to expel the bullet retained in the neck of the cartridge. The explosive force not only stretches the cartridge case longitudinally, it also expands the body and neck of the cartridge case. The neck is the open ended section of the cartridge case in which the bullet was seated.

To insure that the cartridge case is of proper size and is of permitted tolerance, the individual will resize the case prior to reloading.

When the cartridge case is resized,.the diameters of the body and neck must be "shrunk" down to the original tolerances. The resizing of the case is performed in a die that surrounds the cartridge and as the cartridge is forced into the die the external diameters of the body and neck of the cartridge are reduced. This "shrinking" or reduction of the external diameters also affects the internal diameter of the neck. The internal diameter of the neck will ultimately receive a bullet in the reloading process. It is therefore important to have the internal neck diameter resized to ensure the proper seating of the new bullet. The proper seating of the bullet in the neck that has the proper internal diameter assures repetitive exit velocities of the bullets from the muzzle of a firearm from cartridge case to cartridge case having the same powder charges.

It is therefore an object of the present invention to provide means for resizing a cartridge case to provide uniformity of the case not only in regard to the external body and neck diameters, but the internal diameter of the neck as well.

BRIEF SUMMARY OF THE INVENTION

The present invention is a multiple purpose die for use in a reloading operation of cartridge cases. In one embodiment, the die will lubricate the external surface of the body of the cartridge case, remove the spent primer, resize the external diameters of the body and neck of the case, wipe and lubricate the internal surface of the neck and resize the internal neck diameter of the case.

A preferred embodiment of the die has a built in reservoir for the uniform replenishing of a lubricant to a lubricating pad. The pad will uniformly coat the external surface of the case as the case is inserted into the die preparatory for the external resizing operation. The die has a decapping rod installed for removal of the spent primer. Fitted to the decapping rod is an expander ball that enters the cavity of the cartridge as the cartridge is inserted into the die. A wiper that will wipe the interior neck portion and apply a light film of lubricant to the interior neck diameter is positioned strategically in reference to the expander ball. As the case enters the die by the action of the press ram, the exterior surface of the case is lubricated and as the case progresses into a defined profile in the cavity of the die, the external diameters of the case are resized. This action tends to also reduce the interior diameter of the neck. As the cartridge is retracted out of the die, the wiper will wipe any residue off the interior diameter of the neck and apply a light film of lubricant onto the interior surface. The expander ball then resizes the interior diameter of the neck to the desired tolerance as the cartridge case is retracted out of the die.

Other objects and advantages will be apparent from the drawings and the detailed description.

BRIEF DESCRIPTION OF THE DRAWINGS

FIG. 6 is an alternate embodiment of a die and an oil cup for replenishing lubricant to a pad of the die; and, FIG. 7 shows the die of FIG. 6 inverted with an inserted oil cup.

DESCRIPTION OF THE PREFERRED EMBODIMENT

Resizing a cartridge case is an important operation performed in a reloading operation. The cartridge case which was expanded or distorted when fired, must be resized prior to reloading the case with a new primer, powder charge and bullet. Not only is it desirable to resize the external neck diameter, it is also important to size the internal neck diameter. A new bullet (slug) will be seated in the neck of the cartridge case during the reloading operation. For proper seating of the bullet, the internal neck diameter should be of the proper shape and dimension.

Figure 1:
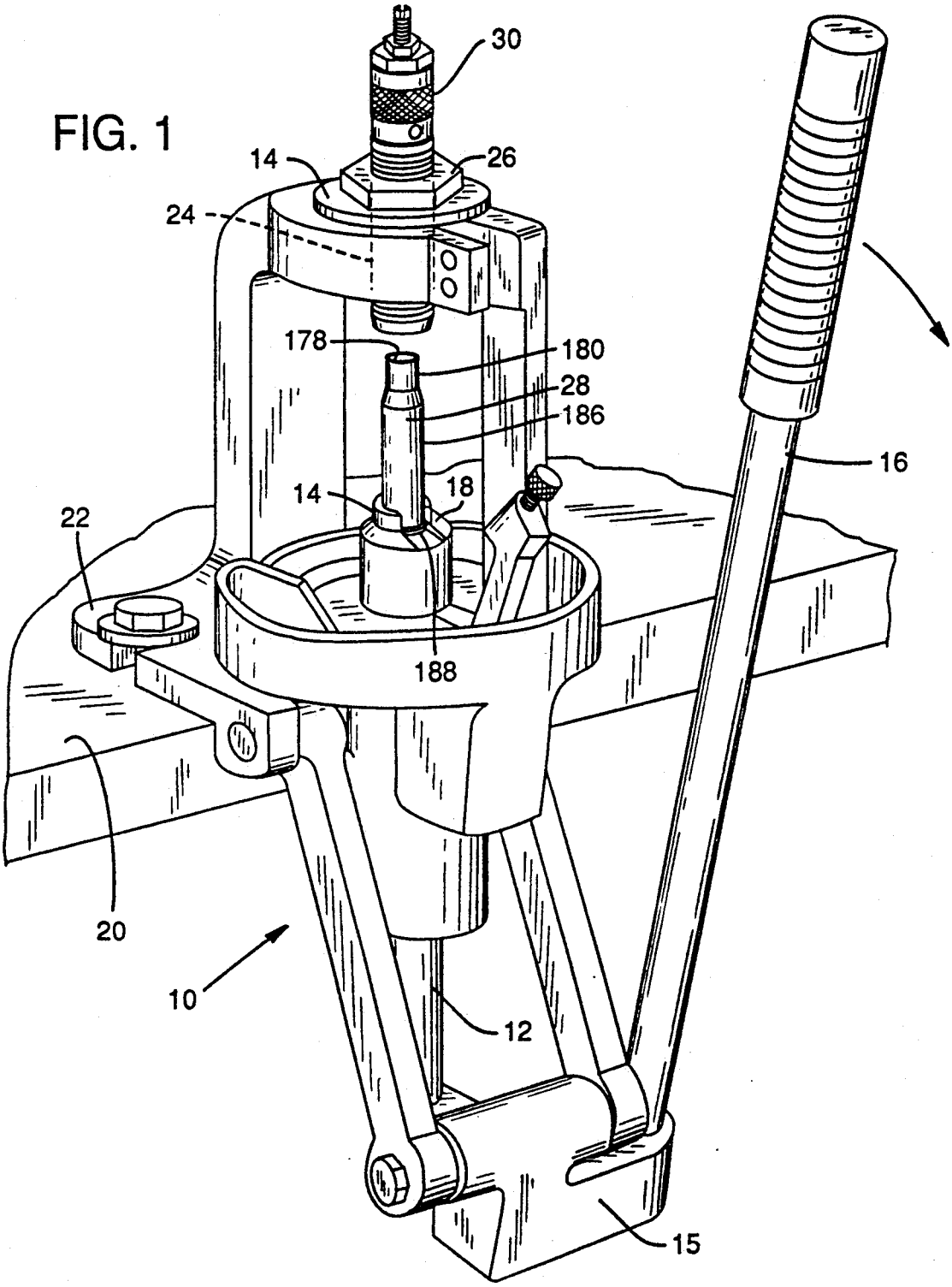
FIG. 1 is a view of a reloading press utilized in a reloading operation.

Refer now to FIG. 1 of the drawings. It illustrates a single station reloading press 10. The single station press 10 is well known to those skilled in the art and therefore a detailed description will not be provided. As is known, the press 10 has a moveable ram 12 that is aligned relative to a die block (holder) 14. The ram 12 is moveable toward and away from the holder 14 by related mechanism (generally indicated by numeral 15) connected to the operating handle 16. Mounted on the upper end of the ram 12 (as viewed in the figure) is a cartridge case holder (retainer) 18. The press is mountable to work surface 20, such as a bench, by mounting brackets 22.

The die block (holder) 14 is provided with a threaded bore 24 (hidden from view) for the adjustable mounting of an externally threaded die 30. The die 30 is threadably inserted into the bore 24, is adjusted to the proper operating height relative to the stroke of the ram 12 and is secured in position by a locknut 26. A cartridge case 28 inserted into the holder 18 will thus be in alignment with the die 30 and more specifically to the internal cavity of the die 30. It should be understood that the die referenced by the numeral 30 may be any one of the dies used in a reloading operation. The die(s) 30 are interchangeable in the die holder 14.

The cartridge case 28, such as a bottle neck cartridge case as illustrated in FIG. 1, is cylindrical in shape having an open end 178. A neck 180 is adjacent the open end 178 and has an external diameter 182 and an internal diameter 184. The neck 180 tapers outwardly at the lower end of diameters 182, 184 to blend with a cylindrical body 186. A base 188 is formed at the bottom of the body 186. As will be seen in FIGS. 5*a* and 5*b*, the base 188 has a center through bore 190 for receiving a primer 192.

Movement of the operating handle 16 in a downward direction (as viewed in FIG. 1) will thus move the case 28 in the holder 18 on the end of the ram 12 toward the die 30; and as movement of the handle continues, the case 28 will enter the die 30. As the case 28 enters the die 30, a reloading operation will be performed depending on the die function. If for example, a die such as disclosed in U.S. Pat. No. 4,890,534 Lubricating Die For Cartridge Reloader (which has been incorporated by reference) was installed in the die holder 14, the spent primer 192 would be ejected from the case 28 and the external surface of the case 28 would be uniformly coated with a light film of lubricant preparatory to a resizing operation.

Those skilled in the art recognize that minimizing the number of steps or operations required in a reloading operation reduces the chance of error and also reduces the time required to perform a loading operation. This is particularly true when using a single station reloading press where one operation is performed on a case (or a number of cases) using one die and then changing the die in the press to perform a subsequent operation.

A preferred embodiment of the present invention is a multiple purpose die that will perform, in a single operative stroke of the press, the operations of uniformly lubricating the case exterior surface, eject the spent primer, resize the external diameter of the case including the neck, wipe and lightly lubricate the internal neck surface (i.e., its internal diameter) and resize the internal neck of the cartridge case.

Figure 2:
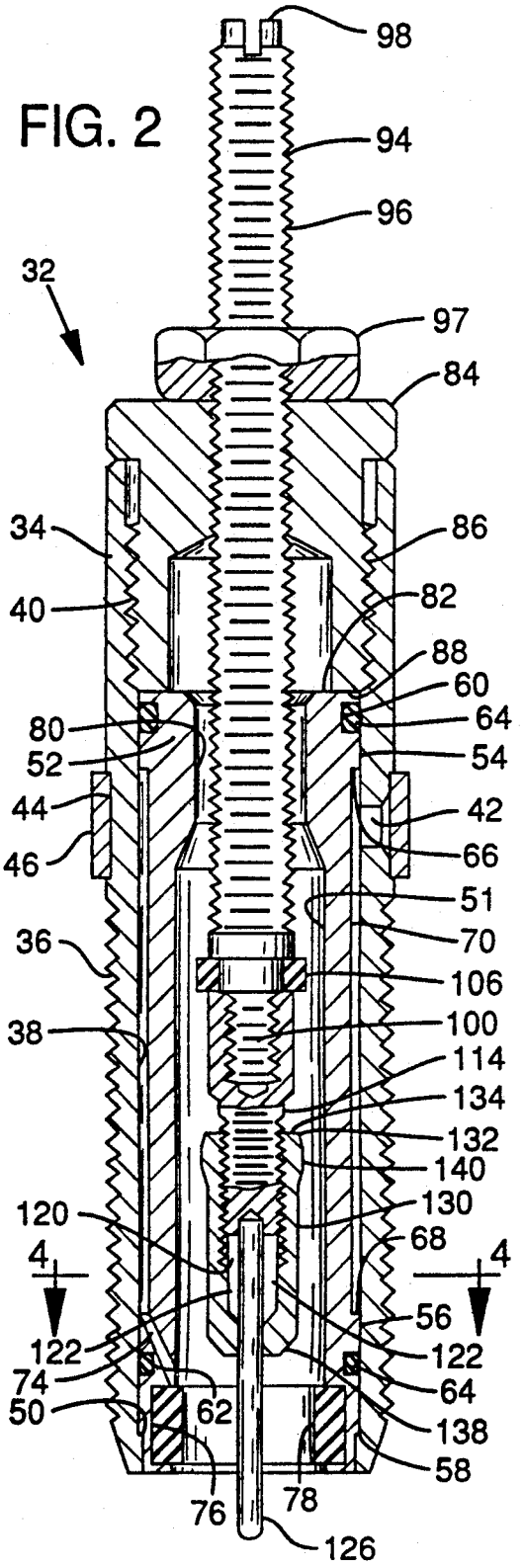
FIG. 2 is a sectional view of a reloading die of the present invention.

Refer now to FIG. 2 of the drawings which illustrates in sectional view, a multiple purpose die 32. A body 34 of the die 32 is cylindrical in shape and has external threads 36 on its lower portion for threadably mounting the die 32 in the die holder 14 of the press 10. As shown, the body 34 has a defined through bore (cavity) 38 with an upper portion of the bore 38 having internal threads 40 for receiving a bushing 84 and a lower end of the bore 38 being of reduced diameter thereby forming a shoulder 50. The bore 38 is configured to receive the removable installation of an insert 52. An aperture 42 is provided in the side wall of the body 34, being centrally positioned relative to a groove 44. A resilient ring 46 removably installed in the groove 44 encircles the body 34 to cover the aperture 42.

Figure 4:
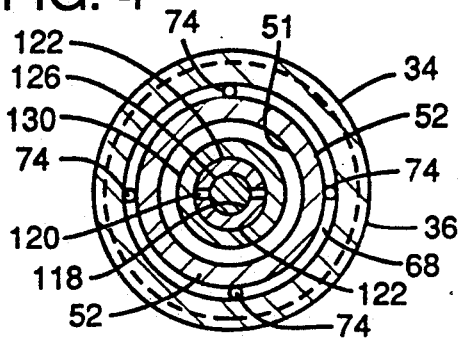
FIG. 4 is a view along view lines 4—4 of FIG. 2.

The insert 52 is basically cylindrical in shape having a defined through bore 51 and having an external diameter at its upper portion generally indicated by numeral 54 and an external diameter at its lower portion generally indicated by numeral 56 that fit closely within the bore 38 of the body 34. As shown, the lower end of the insert 52 adjacent the lower diameter portion 56 is of reduced diameter thus forming a shoulder 58. An annular O-ring groove 60 is provided in the upper diameter portion 54 and an annular O-ring groove 62 is provided in the lower diameter portion 56, the grooves 60 and 62 each for receiving an O-ring 64. The external diameter of the insert 52 between the upper diameter 54 and the lower diameter 56 is of a diameter less than the diameters 54, 56 and extends from a shoulder 66 at the lower end of diameter 54 to a shoulder 68 at the upper end of diameter 56 (as viewed in the figure). The reduced diameter provides a space 70 between the wall of the bore 38 of the body 34 and the reduced diameter of the insert 52. The space 70 provides a reservoir for the containment of a lubricant. The aperture 42 in the sidewall of the body 34 communicates with the reservoir 70 and the ring 46 is merely slid up on the body to expose the aperture 42 for replenishing lubricant in the reservoir 70. Multiple ports 74 (i.e. bored holes) are provided around the periphery of insert 52 that extend from the shoulder 68 to a formed annular groove 76 provided at the internal lower portion of the bore 51 of the insert 52. The formed groove 76 retains a resilient ring shaped lubricating pad 78, such as a felt or sponge. The ports 74 are thus passageways inter-connecting the space (reservoir) 70 and the groove 76 for the replenishment and even distribution of lubricant to the pad 78. The ports 74 are further detailed in FIG. 4. The pad 78 defines a circular opening and is placed in an entry to the die 32 through which a cartridge case 28 is insertable. The O-rings 64 fitted in the grooves 60, 62 provide a seal between the body 34 and the insert 52 to prevent leakage of lubricant.

The insert 52 has a defined through bore 51 that matches the shape of a new cartridge case and will resize a deformed case as it is forced into the defined bore. The upper end of the bore 51 (as viewed in the figure) has an internal profile, generally indicated by numeral 80 that matches the external profile of a neck portion of a cartridge case 28. The profile 80 is of a shape and diameter to provide a resizing capability of the neck portion of a cartridge case 28 when it is forcibly inserted into the profile 80 by action of the ram 12 of the press 10.

The insert 52 is removably installed (and thus replaceable) in the body 34 with the shoulder 58 of the insert abutting the shoulder 50 of the body 34. A bushing 84 having external threads 86 is screwed into the body 34 with the threads 86 engaging the threads 40 of the body 34. A lower face 88 of the bushing 84 abuts the upper surface 82 of the insert 52 to thus retain it in position within the body 34.

Figure 3:
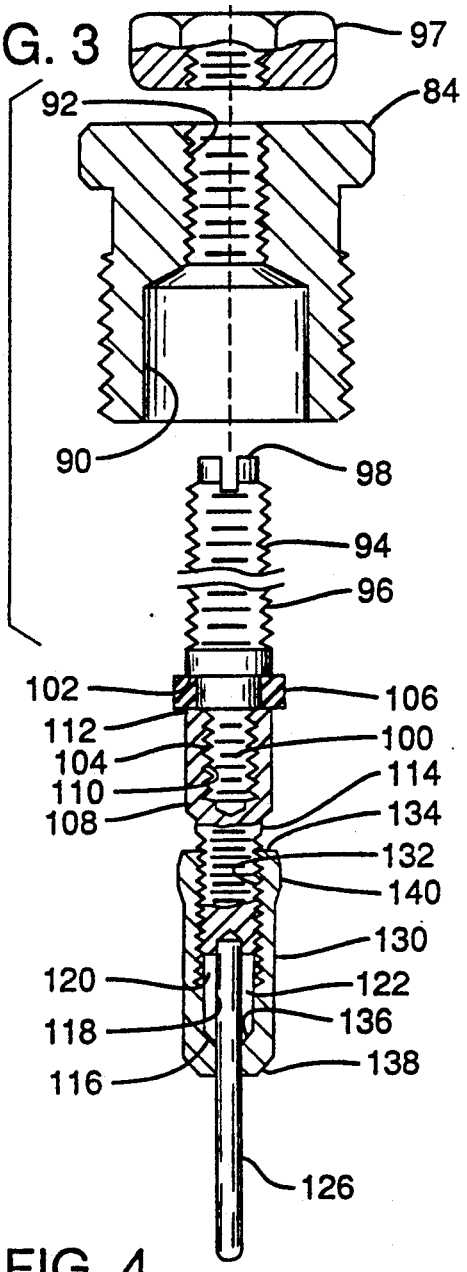
FIG. 3 is a view of a decapping rod assembly including a wiper, an expander ball and a decapping pin.

Refer now also to the view of FIG. 3. The bushing 84 has a stepped center through bore 90 having internal threads 92 in the smaller diameter for receiving a decapping rod 94. The decapping rod 94, a shaped elongate cylindrical member, has external threads 96 commencing from a slotted end 98 as shown in the figure. A threaded lock nut 97 is provided to lock the rod 94 relative to the bushing 84. An end portion of the rod 94 opposite the slotted end 98, generally indicated by the numeral 100, is of a reduced diameter. The end portion 100 includes a shoulder 102 and has external threads 104 extending along a portion of its length. The non-threaded length of the end 100 between the shoulder 102 and the threads 104 provide a mounting surface for a resilient ring shaped wiper 106. The wiper 106, being ring shaped, has an internal diameter corresponding to the diameter of the end portion 100 and an external diameter corresponding to the internal neck diameter of a new cartridge case. The wiper 106 is preferably of a felt or sponge material that will hold a quantity of lubricant. The wiper 106 abuts the shoulder 102 and is retained in position by a rod tip 108.

The rod tip 108 is a configured cylindrical member having a threaded bore 110 in an end 112 which will threadably engage the threads 104 of the rod 94 to secure the tip to the rod 94 and also to retain the wiper 106 in position against the shoulder 102. The wiper 106 is held captive between end 112 of the tip 108 and the shoulder 102 of the rod 94.

A center section of the tip 108, generally indicated by the numeral 114 is threaded to accept the installation of an expander ball 130. An end 116 of the tip 108 has a bore 118 of a diameter to accept a decapping pin 126. The end 116 has a formed slot 120 transverse to the longitudinal axis of the tip 108 and intersecting the bore 118 thus forming two fingers 122 on end 116. The ends of the fingers 122 are tapered as shown in the figure.

The expander ball 130, having a threaded bore 132 formed in end 134 is installable (and replaceable) on the tip 108 with the threads of the bore 132 engaging the threaded center section 114 and with the fingers 122 received within the bore 132. The bore 132 has a tapered end 136 corresponding to the taper on the ends of the fingers 122. End 138 of the expander ball 130 has a bore 140, preferably of diameter just larger than the pin 126, that is coaxial and extends into the bore 132. The tapered end 136 cooperates with the taper on the end of the fingers 122 to collapse the fingers 122 on the pin 126 (similar to a collet) as the expander ball 130 is threaded onto the rod tip 108. The expander ball 130 is basically cylindrical in shape excepting for an external portion near end 134 that has a section 140 that preferably has a shape that is toroidal, being of a dimension that will re-size the internal neck diameter 182 of a cartridge case 28. The expander ball 130 is selected to correspond to the caliber of the case 28 to be resized by the insert 52.

The insert 52 is interchangeable and replaceable in the body 34 with another insert 52 having an internal profile of another caliber of cartridge case. Thus, a user does not need a plurality of dies, but merely has inserts 52 with pads 78 and matching expander balls 130 corresponding to the calibers of the cases that are to be reworked (i.e., resized). It is also preferable to have matching wipers 106.

Refer now to FIGS. 5*a*, 5*b*, 5*c* and 5*d* of the drawings. They show the die 32 with the insert 52 installed in the body 34 and retained by bushing 84. The decapping rod 94 is threadably installed in the bushing 84. The wiper 106 is retained by the rod tip 108 mounted on the end of the decapping rod 94. The expander ball 130 is mounted to the rod tip 108 and the decapping pin 126 is fitted in and retained by the collapsed fingers 122. The rod 94 is locked in the adjusted position by locknut 97. The aperture 42, which communicates with the reservoir 70, is utilized to fill the reservoir 70 with lubricant. The lubricant flows from the reservoir 70 to the lubricating pad 78 via the ports 74 by gravity and combined with capillary action, the lubricant is uniformly distributed throughout the pad 78.

To perform the reloading operations, the die 32 is threadably installed in the die holder 14 of the press 10 (shown in FIG. 1), is adjusted to the proper height relative to the ram 12 and is locked in position by locknut 26. A cartridge case 28 is inserted in the holder 18 (with the ram near the bottom of its stroke). As is known the case 28 is retained in the holder by its rim (base) with the open end 178 of the case neck 180, directed toward and aligned with the entry of the die 32.

Movement of the operating handle 16 will thus move the cartridge case toward and insert the case into the cavity of the die 32, the cavity of the die defined by the bore 51 of the insert 52. For clarity, only the relative positions of the die 32 and the case 28 are shown in the FIGS. 5*a*, 5*b*, 5*c*, and 5*d*. The die 32 would normally be installed in a press 10 as described, the movement and entry of the case 28 into the die caused by the movement of the ram 12. Movement of the ram in the opposite direction of course retracts the case 28 out of the die 32.

Figure 5A:
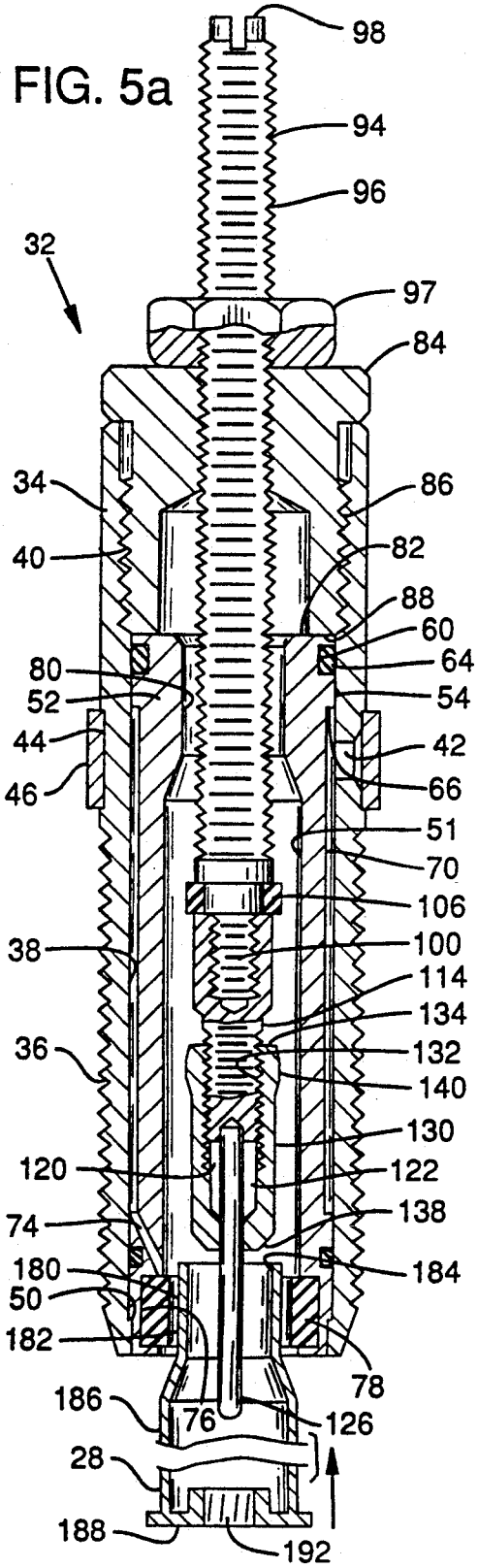
FIG. 5*a*, 5*b*, 5*c*, and 5*d* illustrate the progressive steps in resizing a cartridge case using the die of FIG. 2.

FIG. 5*a* shows the relation of the cartridge case 28 and the die 32 just as the neck 180 of the case 28 is entering the cavity of the die 32.

Figure 5B:
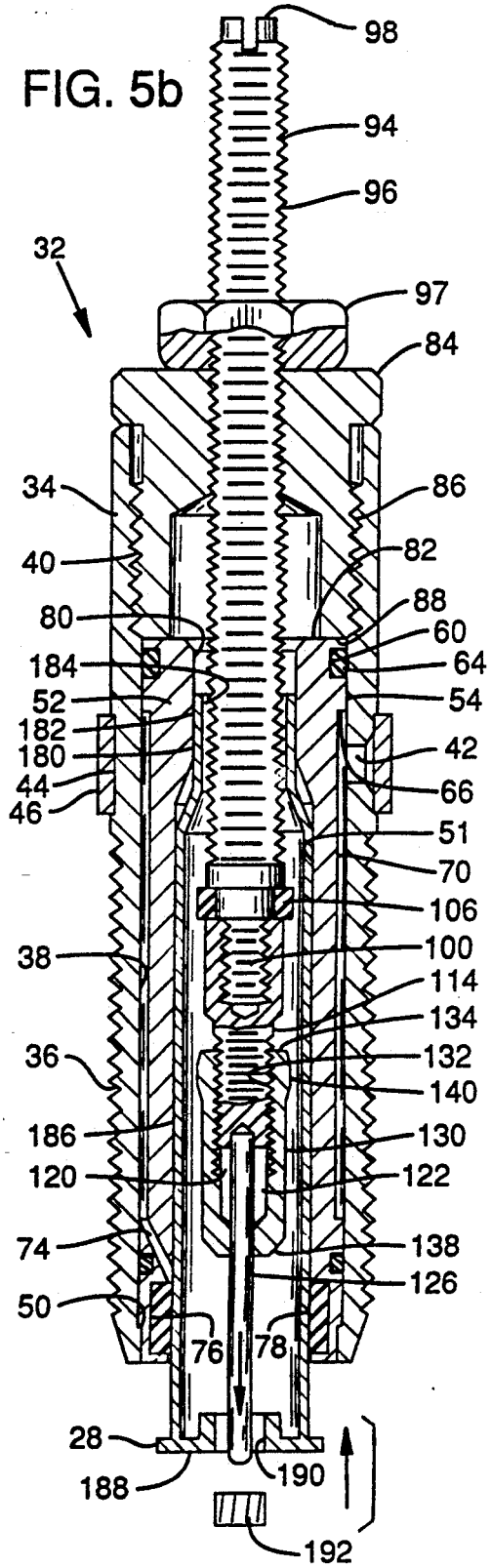

FIG. 5*b* shows the case 28 inserted further into the cavity of the die 32. The pad 78 is sufficiently resilient to allow passage of the main body of the cartridge case. The body, as it passes through the pad 78 in sliding frictional contact is uniformly coated with lubricant. As is shown, the decapping pin, expander ball, rod tip, and wiper have entered the interior of the case through the neck opening 178. Recall that the cartridge case neck 180 has been expanded by being previously fired so that the expander ball will enter freely. The wiper 106, being resilient and of a diameter closely approximating a new cartridge case internal neck diameter 184, will compress during entry into the neck of the case 28. As the wiper 106 enters the neck of the case, it will wipe the interior surface of the neck thus removing any residue and will deposit (i.e, coat) a film of lubricant on the interior surface area of the neck. As the neck 180 of the case enters the internal profile 80, the decapping pin 126 will eject the spent primer 192 from the base 188 of the case 28.

Figure 5C:
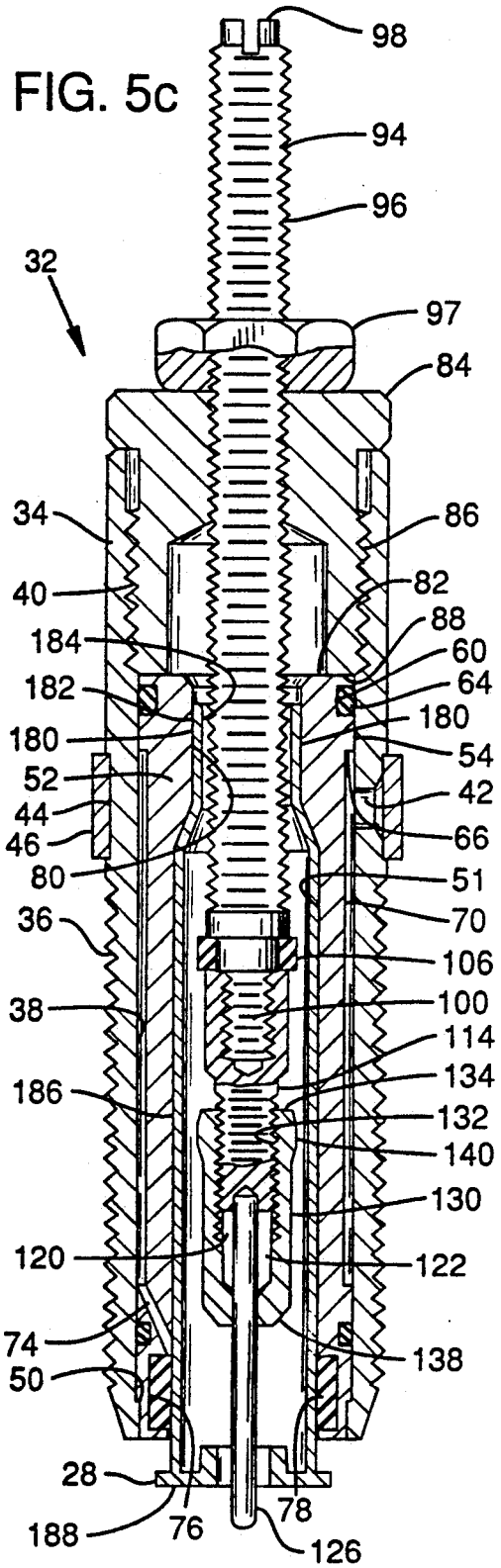

FIG. 5*c* shows the cartridge case 28 fully inserted in the die 32. The cartridge case external diameters have been resized by the defined profile of the bore 51 including the neck 180 of the cartridge case which has entered and has been resized by the profile 80.

Figure 5D:
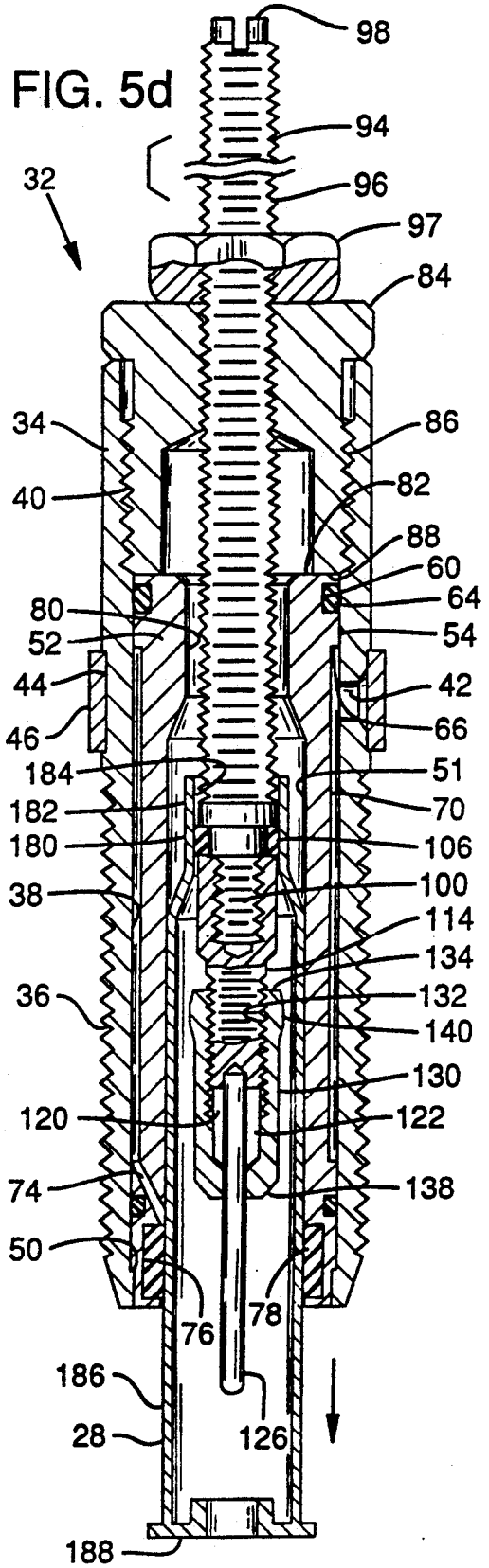

FIG. 5*d* shows the case 28 being retracted out of the die 32. The wiper 106 will once again wipe and lightly lubricate the interior surface of the neck 180 of the case. The section 140 of the expander ball 130, as it passes through the neck 180 of the case as the case is retracted, will resize the interior neck diameter 184 of the case.

The die 32 in a single operative stroke of the press 10 thus uniformly lubricates the exterior surface of the body of the case, ejects the spent primer from the case, resizes the body and neck exterior, wipes and lightly lubricates the interior surface of the neck, and resizes the neck interior diameter.

Refer now to FIG. 6 which illustrates an alternate embodiment of a multiple purpose die 32'. The die 32' is interchangeable with the die 32 having external threads 144 for mounting the die 32' in the holder 14 of the press 10. The die 32' has a defined cavity formed by a configured through bore 146. Near the lower end of the bore 146 (as viewed in the figure) an annular groove 148 is provided for the retention of a ring shaped lubricating pad 150. The pad 150 in the groove 148 is in the entry to the cavity of the die 32', being positioned near the bottom face 152. Threads 154 are provided in the bore 146 at end 155 of the die 32' for the threadable insertion of a threaded bushing 156. The bushing 156 has a threaded center through bore 158 for receiving the decapping rod 94 in the same manner as with die 32 previously described. The lower portion of the bore 146, as shown, has a profile corresponding to a new cartridge case.

The lubricating pad 150 is replenished with lubricant by a cup shaped oil dispenser 160. The dispenser 160 has a circular bottom 162 and a cylindrical wall 164 extending from the bottom 162 to a top edge 166, thus defining a cavity for receiving lubricant. An outwardly extending annular flange 168 is provided on the top edge of the cylindrical wall 164. Multiple spaced bores 170 are provided in the wall 164 near the bottom 162 for the passage of lubricant. A cylindrical plunger 172 is insertable into the cavity defined by the wall 164. An O-ring 176 installed in a groove 174 located near one end of the plunger 172 ensures a seal between the plunger 172 and the wall 164.

To replenish the lubricant in the lubricating pad 150, the die 32' is inverted as shown in FIG. 7 (i.e., the entry facing upward). The dispenser 160 is inserted into the cavity of the die with the flange 168 abutting the bottom face 152 This places the bores (ports) 170 adjacent the lubricating pad 150. A quantity of lubricant is placed in the dispenser 160 and the plunger 172 is inserted into the cavity of the dispenser 160. The plunger 172 is forced toward the bottom 162 to thus force the lubricant through the ports 170 to transfer the lubricant to the pad 150.

Figure 8:
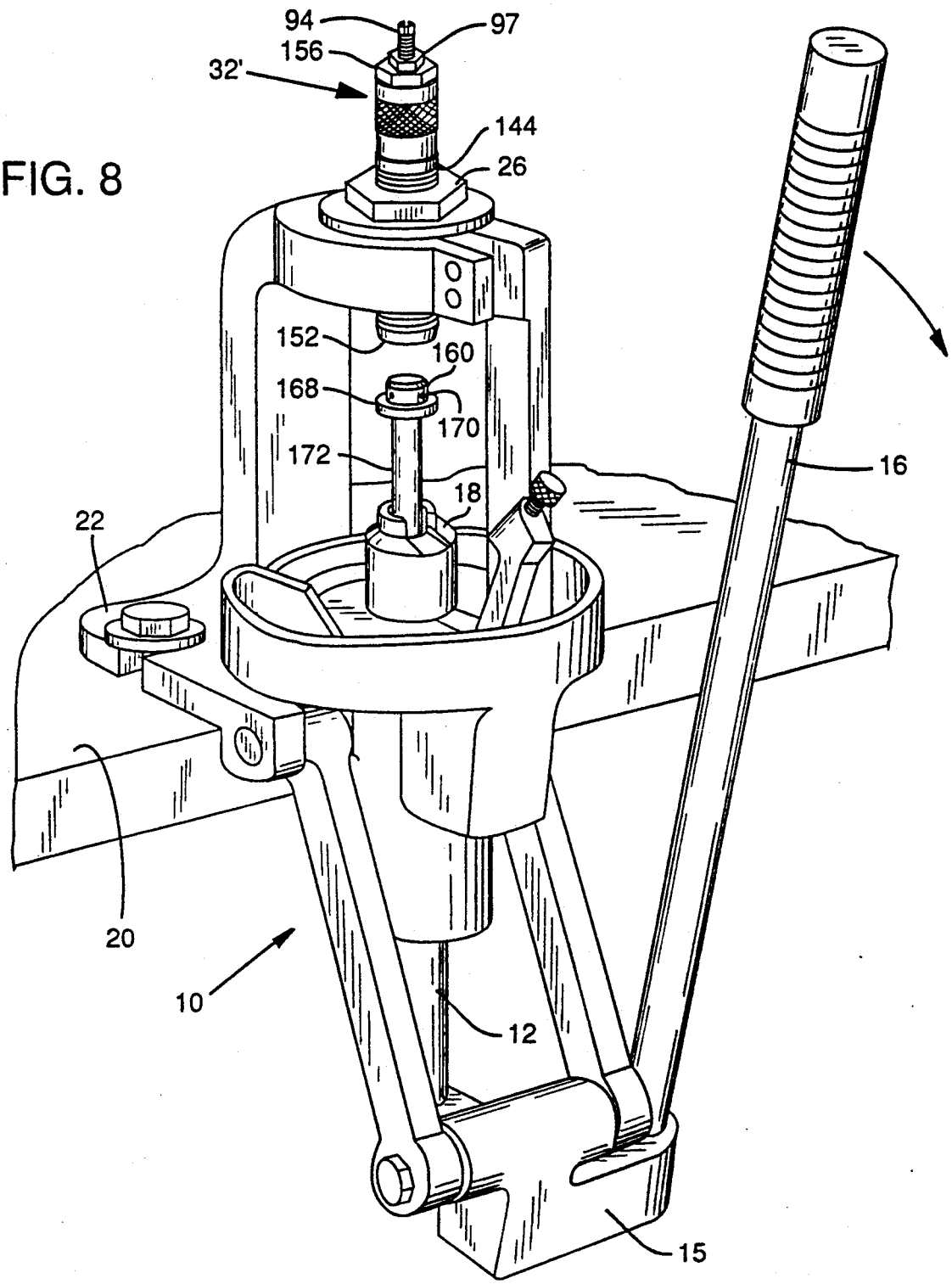
FIG. 8 shows an alternate method of replenishing lubricant to the pad of the die of FIG. 6.

FIG. 8 shows an alternate method of replenishing lubricant to the pad 150 of the die 32'. The die 32' is installed in the press 10 in a conventional manner. A quantity of lubricant is placed in the dispenser 160, and the plunger 172 is inserted into the cavity of the dispenser 160. The plunger 172 of the assembled dispenser and plunger is placed in the case holder 18 as shown in the figure. Movement of the handle 16 of the press 10 will thus move the dispenser 160 into the entry of the die 32' with flange 168 abutting the bottom face 152. As movement of the plunger 172 continues, the lubricant will be forced through the bores 170 to transfer the lubricant to the pad 150.

It will be apparent to those skilled in the art that modifications and variations made be made without departing from the scope and true spirit of the invention. The invention is therefore not to be limited to the drawings, specification or a preferred embodiment but is to be determined from the appended claims.

What is claimed is:

1. A multiple purpose die for performing resizing operations on a spent cartridge case having a side wall that defines a profile that is expanded as compared to its original side wall profile, said die comprising;

a body having a cavity and having an entry to said cavity, said entry permitting a spent cartridge case to enter into and retract out of said cavity, said cavity having a profile adapted to resize said cartridge to return it to its original side wall profile;

a resilient ring shaped pad containing a lubricant, said pad mounted in said entry, said pad fully encircling said spent cartridge case in sliding contact with the side wall of said case as said case enters said cavity and thereby uniformly lubricating said side wall of said case; and said pad mounted in said entry and said profile of said cavity arranged to cooperatively and sequentially lubricate and then resize the exterior of said case as said case enters said profile of said cavity.

2. A multiple purpose die as defined in claim 1, including;

means for replenishing the lubricant contained in said pad.

3. A multiple purpose die as defined in claim 2, wherein the replenishing means includes;

a dispenser having a cavity defined by a cylindrical wall, said cavity for receiving and containing a quantity of the lubricant, a wall of said dispenser having a bore for the passage of the lubricant, said dispenser insertable into said entry of said cavity of said body with said bore adjacent said pad;

a plunger insertable and moveable into said cavity of said dispenser thereby transferring the lubricant contained in said cavity of said dispenser to said pad through said bore.

4. A multiple purpose die for performing resizing operations on a spent cartridge case having a side wall that defines a body portion and a reduced neck portion and having a profile that is expanded as compared to its original side wall profile, said die comprising;

a die body having a cavity and having an entry to said cavity, said entry permitting a spent cartridge case to enter into said retract out of said cavity, said cavity having a profile adapted to resize said cartridge to return it to its original side wall profile;

a resilient ring shaped pad containing a lubricant, said pad mounted in said entry, said pad fully encircling said spent cartridge case in sliding contact with the side wall of the body portion of said case as said case enters said cavity and thereby uniformly lubricating said side wall of the body portion of said case;

said pad mounted in said entry and said profile of said cavity arranged to cooperatively and sequentially lubricate and then resize the exterior of said case as said case enters said profile of said cavity; and an expander ball for resizing an internal neck diameter of the neck portion of said case, mounting means for mounting said ball within said cavity of said die body, said ball entering an interior of said case upon entry of said case into said cavity;

said profile of said cavity and said expander ball arranged to cooperatively and sequentially resize the exterior of said case as said case enters said profile of said cavity and to resize said internal neck diameter of said case during retraction of said case from said cavity; and a wiper, mounting means for mounting said wiper within said cavity of said die body whereby said wiper enters said interior of said case as said case enters said cavity, and wipes said internal diameter of said neck upon retraction of said case prior to resizing by said ball.

5. A multiple purpose die for performing re-sizing operations on a cartridge case having a desired configuration including a main body portion having a defined internal diameter and a reduced neck portion having a defined internal diameter, said die comprising;

a die body having a cavity and having an entry to said cavity, said entry permitting a cartridge case to enter into and retract out of said cavity, said cavity having a defined profile for resizing an exterior of said case;

an expander ball for resizing an internal neck diameter of said reduced neck portion of said case, mounting means for mounting said ball within said cavity of said body, said ball entering an interior of said case upon entry of said case into said cavity;

a wiper of compressible material sized at least greater than the defined internal diameter of the neck portion and smaller than the defined internal diameter of the main body portion of said desired configuration for a cartridge case, mounting means for mounting said wiper within said cavity of said body and relative to the expander ball so as to enter the reduced neck portion preceding the entry thereof by the expander ball as the case is withdrawn from the cavity, whereby the wiper is compressed against the interior of the neck portion to wipe said interior upon retraction of said case prior to resizing by said ball; and said profile of said cavity and said expander ball arranged to cooperatively and sequentially resize the exterior of said case as said case enters said profile of said cavity and to resize said internal neck diameter of said case during retraction of said case from said cavity.

6. A multiple purpose die as defined in claim 5, wherein;

said wiper contains a lubricant, and said wiper applying a light film of lubricant to said interior of said neck.

7. A multiple purpose die as defined in claim 6, including;

a decapping rod for ejecting a primer from said case, said rod removably mounted relative to said ball, said rod ejecting said primer of said case as said case enters said cavity.

* * * * *